United States Patent [19]

Carlson

[11] 4,259,883

[45] Apr. 7, 1981

[54] DROP-OUT SOCKET WRENCH

[76] Inventor: Mark E. Carlson, 1610 Becher Dr., Wausau, Wis. 54401

[21] Appl. No.: 109,569

[22] Filed: Jan. 4, 1980

[51] Int. Cl.[3] ..... B25B 13/46

[52] U.S. Cl. ..... 81/62; 81/60

[58] Field of Search ..... 81/60, 61, 62, 63, 63.1, 81/63.2, 177 G

[56] References Cited

U.S. PATENT DOCUMENTS

| | | | |
|---|---|---|---|
| 612,712 | 10/1898 | Doherty | 81/62 |
| 2,757,564 | 8/1956 | Reaves | 81/61 |
| 2,869,410 | 1/1959 | Prichard | 81/63 |
| 3,077,801 | 2/1963 | Rostad | 81/61 |
| 4,218,940 | 8/1980 | Main | 81/177 G |

*Primary Examiner*—James L. Jones, Jr.

*Attorney, Agent, or Firm*—Andrus, Sceales, Starke & Sawall

[57] ABSTRACT

A socket wrench of improved design which not only provides for interchangeability but also for easy removal of the socket member. The ratchet and socket openings are provided in separate annular coaxial members. The ratchet wheel is adapted to loosely receive a removable socket insert. The periphery of the ratchet wheel is provided with a plurality of ball bearings which are mounted in openings which face inwardly toward the socket insert. The socket insert is provided with receiving structure for the ball bearings. A spring wraps around a portion of the periphery of the ratchet wheel and normally biases the ball bearings into locking engagement with the socket insert. The spring is provided with a portion spaced from the ratchet wheel which is actuatable to release the spring tension on the ball bearings, thus permitting the socket insert to freely drop out of the ratchet wheel.

10 Claims, 4 Drawing Figures

FIG. 1
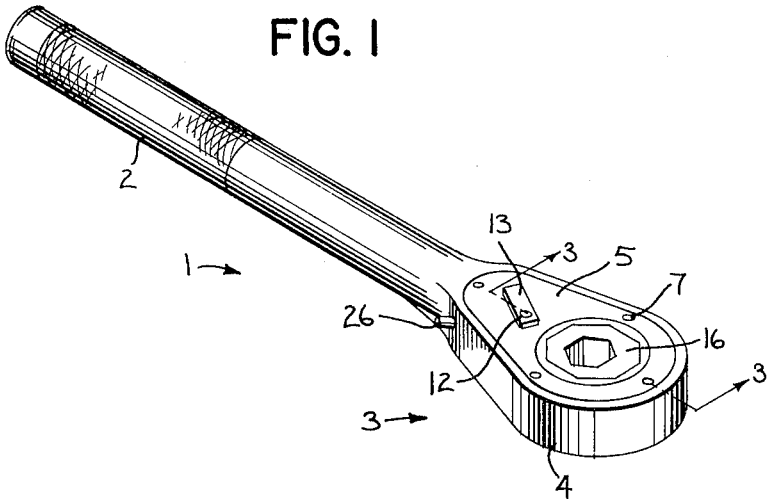
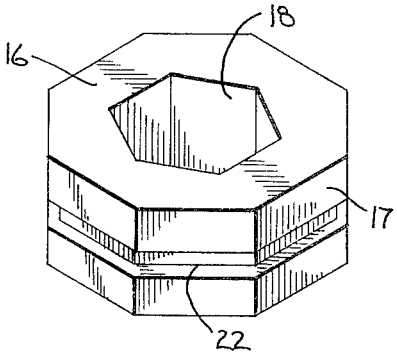
FIG. 4
FIG. 2
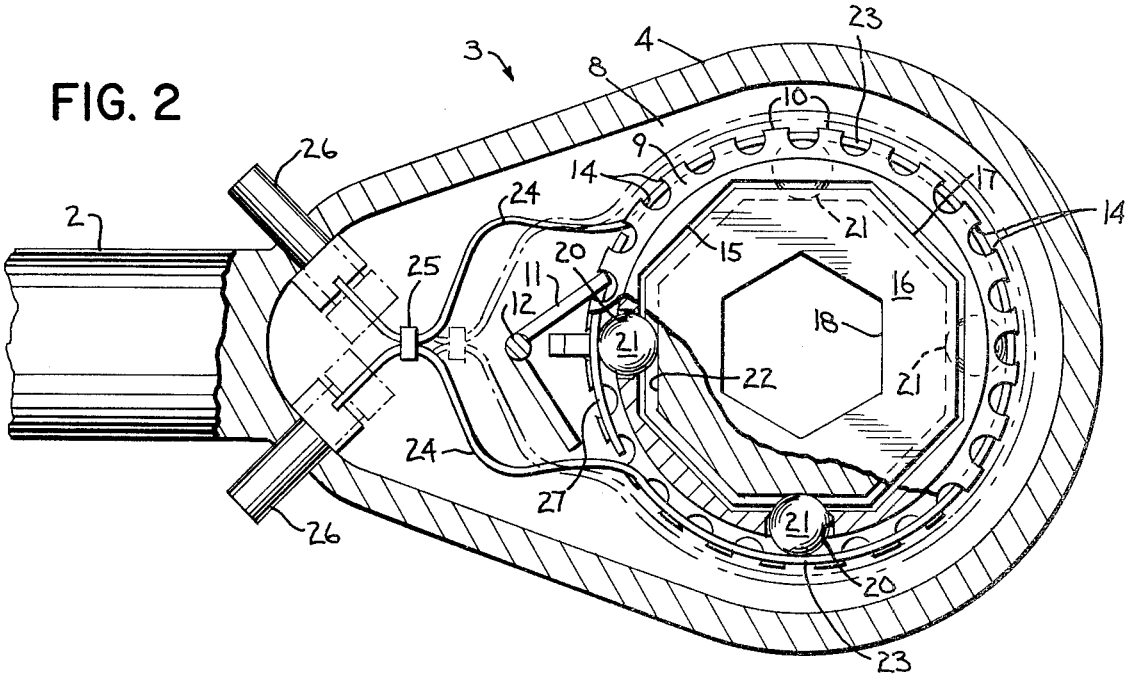
FIG. 3
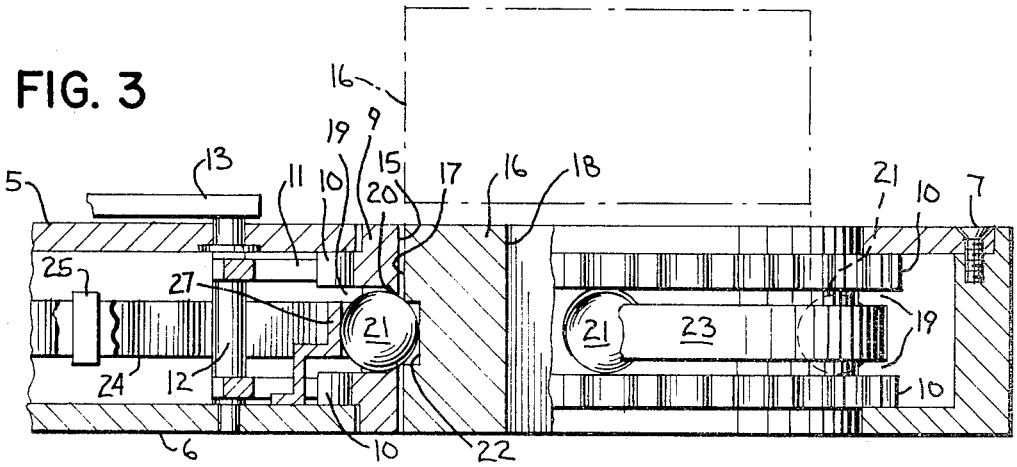

DROP-OUT SOCKET WRENCH

U.S. PRIOR ART OF INTEREST

U.S. Pat. No. 873,977, Albrecht, Dec. 17, 1907
U.S. Pat. No. 934,503, Chapman, Sept. 21, 1909
U.S. Pat. No. 1,010,188, Scott, Nov. 28, 1911
U.S. Pat. No. 1,426,127, Tuttle, Aug. 15, 1922
U.S. Pat. No. 1,503,888, Erickson, Aug. 5, 1924
U.S. Pat. No. 3,598,001, Thomasian, Aug. 10, 1971

BACKGROUND AND SUMMARY OF THE INVENTION

This invention relates to a socket wrench of the ratchet type.

In the broadest sense, such wrenches have long been known. As can be observed from the above identified prior art, these devices have usually included a ratchet wheel having a socket opening therein and having ratchet teeth on the periphery thereof for engagement by a suitable pawl. In some instances, such as for example in U.S. Pat. Nos. 934,503 and 1,503,888, the ratchet wheel may be removable for interchanging with a similar wheel having a different size socket opening. In these patents, the ratchet wheel is removed by pulling of holding pins out of the wrench body or by manually pulling against the force of a spring-pressed ball.

The present invention provides a socket wrench of improved design which not only provides for interchangeability but also for easier removal of the socket member.

In accordance with one aspect of the invention, the ratchet and socket openings are provided in separate annular coaxial members. The ratchet wheel is adapted to loosely receive a removable socket insert.

In accordance with another aspect of the invention, the periphery of the ratchet wheel is provided with a plurality of ball bearings which are mounted in openings which face inwardly toward the socket insert. The socket insert is provided with receiving structure for the ball bearings.

In accordance with a further aspect of the invention, a spring wraps around a portion of the periphery of the ratchet wheel and normally biases the ball bearings into locking engagement with the socket insert. The spring is provided with a portion spaced from the ratchet wheel which is actuatable to release the spring tension on the ball bearings, thus permitting the socket insert to freely drop out of the ratchet wheel.

BRIEF DESCRIPTION OF THE DRAWINGS

The accompanying drawings illustrate the best mode presently contemplated by the inventor for carrying out the invention.

In the drawings:

FIG. 1 is a perspective view of a socket wrench constructed in accordance with the various aspects of the invention;

FIG. 2 is an enlarged horizontal sectional view of the head of the socket wrench, with parts broken away;

FIG. 3 is a vertical section taken on line 3—3 of FIG. 1; and

FIG. 4 is a perspective view of one form of socket insert.

DESCRIPTION OF THE PREFERRED EMBODIMENT

As shown in the drawings, the invention is adapted to be incorporated in a socket wrench 1 having a handle 2 which merges into a head portion 3. Handle 2 may be straight, as shown, or may be offset from head portion 3 in the usual well-known manner. Head portion 3 comprises a side wall 4 which diverges outwardly from the handle end and which forms a semi-circular end portion. Side wall 4 cooperates with top and bottom closure plates 5 and 6 which are attached thereto as by screws 7, and which together with the side wall form a chamber 8 for containing the ratchet mechanism.

The ratchet mechanism includes an annular ring-like ratchet wheel 9 having a plurality of teeth 10 on its outer periphery. A dual-armed pawl 11 is mounted on a vertical shaft 12 which extends upwardly through plate 5 and terminates in a manual shift lever 13 for selectively moving one or the other of the pawl arms into engagement with ratchet teeth 10. Thus, the ratchet is reversable. As shown, teeth 10 include overhanging lips 14 on both edges to assist in keeping pawl 11 engaged.

The inner annular surface 15 of ratchet wheel 9 is non-circular, in this instance octagonal, and is adapted to cooperatingly receive a separate annular socket insert 16 having an outer peripheral wall 17 adapted to correspond with and loosely fit within surface 15, and an inner central opening 18 for fitting over a nut or the like. Plates 5 and 6 are provided with suitable openings which confine ratchet wheel 9 in place but which permit pass-through of socket insert 16.

Socket insert 16 is adapted to be removeably and releaseably held in position within ratchet wheel 9. For this purpose, the outer periphery of ratchet wheel 9 is provided with an annular groove 19 which, in effect, divides each tooth 10 into upper and lower segments. A plurality of inwardly facing openings 20, in this instance four equally spaced, are disposed on the inner wall of groove 19 with each opening adapted to receive a ball bearing 21 which is disposed in the groove. The relative sizes of openings 20 and ball bearings 21 are such that the latter extend partly through the former for engaging the outer peripheral wall 17 of socket insert 16.

Wall 17 of insert 16 is provided with means for receiving ball bearings 21 for holding insert 16 in axial position relative to ratchet wheel 9. For this purpose, and in the embodiment shown, this means comprises an annular groove 22 disposed centrally in wall 17. Other recess means in wall 17 and adjacent openings 20 might be used to receive ball bearings 21 without departing from the spirit of the invention.

It is contemplated that ball bearings 21 are selectively and releasably held in place to lock the assembly together. For this purpose, and in the present embodiment, a loop-like fixed leaf spring 23 is disposed and contoured to wrap around a portion of the ratchet wheel groove 19 on the side remote from handle 2. The extent of wrap around should be substantially more than 180°, and should be such that spring 23 is closely adjacent those ball bearings 21 disposed therebeneath in groove 19.

On the side of ratchet wheel 9 near handle 2, the portions of the loop spring bend away from the wheel to form an inner pair of opposed generally L-shaped arms 24 which converge to a bracket 25. On the opposite side of bracket 25, the spring loop portions diverge outwardly, with the end of each secured to the inner end of a release plunger 26 which extends through head side wall 4.

The construction is such that spring 23 normally biases three of the four ball bearings 21 radially inwardly so that the latter are tightly confined against ratchet wheel openings 20 and thus groove 22 of socket insert 16. In the annular area between spring arms 24, the fourth ball bearing 21 may be confined in groove 19 by a separate spring-like track 27 fixedly mounted to plate 6.

During use of the wrench, and with the parts assembled, rotational forces applied to socket insert 16 cause ratchet wheel 9 to turn, due to the non-circular connection therebetween. At the same time, ball bearings 21 will ride on the inner wrapped around surface of spring 23 or track 27, and at the same time will lock socket insert 16 in place.

For purposes of quick release and replacement of insert 16 with another one of different size, unlocking means are provided to release the inward biasing force of spring 23 against the ball bearings 21 adjacent thereto. This may be accomplished by changing the relative position of arms 24, such as by increasing the distance therebetween to effectively open and enlarge the diameter of the circular wrapped-around part of the loop. In the present embodiment, this is accomplished by merely pressing on plungers 26 in a pinching action, which will cause the spring to flex to the position shown in phantom lines in FIG. 2. The adjacent ball bearings 21 will then be free to back off and disengage from socket insert groove 22 so that the insert will merely pop or drop out of the head to provide a quick release.

If a fourth ball bearing 21 and track 27 are used, the quick drop-out action will not be adversely affected provided there is sufficient tolerance between wheel 9 and socket insert 16.

Various modes of carrying out the invention are contemplated as being within the scope of the following claims particularly pointing out and distinctly claiming the subject matter which is regarded as the invention.

I claim:

1. A socket wrench comprising:

(a) a handle, (b) a head portion on said handle, (c) a ring-like ratchet wheel disposed for rotation on said head portion and with said ratchet wheel having teeth on its outer periphery and a non-circular inner surface, (d) pawl means for engaging said teeth, (e) an interchangeable annular socket insert having a central opening and having an outer peripheral wall fitting within said inner surface of said ratchet wheel, (f) a plurality of ball bearings operatively connected between said ratchet wheel and said socket insert for holding said wheel and insert in axially assembled relationship, (g) means for locking said ball bearings in wheel-insert holding position, (h) and quick-release means connected to unlock said locking means so that said ball bearings are released from their holding position and said socket insert freely drops out of said ratchet wheel.

2. The socket wrench of claim 1 which includes:

(a) an annular groove disposed in the said outer periphery of said ratchet wheel, (b) a plurality of spaced inwardly facing openings disposed in said groove and with said openings adapted to receive said ball bearings, (c) and recess means disposed in said outer peripheral wall of said socket insert adjacent said openings for engagement by said ball bearings.

3. The socket wrench of claim 2 wherein said recess means comprises an annular groove disposed in said outer wall of said socket insert.

4. The socket wrench of claim 2 or 3 wherein said locking means comprises spring means for biasing said ball bearings toward said openings and into said recess means.

5. The socket wrench of claim 2 wherein said locking means comprises:

(a) a loop spring wrapped around one side of said ratchet wheel groove for biasingly engaging said ball bearings, (b) said spring bending away from the other side of said groove to form an inner portion connected to said quick-release means.

6. The socket wrench of claim 5 wherein said loop spring wraps around said ratchet wheel more than 180°.

7. The socket wrench of claim 5 or 6 wherein:

(a) the inner end portion of said loop spring forms a pair of arms, (b) and said quick-release means comprises means to change the relative position of said arms to enlarge the diameter of the wrapped-around portion of said loop spring to release the biasing force against said ball bearings.

8. The socket wrench of claim 7 wherein said position changing means comprises manually actuatable plungers mounted to said head portion and connected to said pair of arms.

9. The socket wrench of claim 7 wherein the construction is such that during combined rotation of said socket insert and said ratchet wheel, said ball bearings ride on the inner surface of the wrap-around portion of said loop spring and also lock said socket insert in place.

10. In the socket wrench of claim 7: a fixed spring-like track disposed between said arms for confining a said ball bearing in said groove.

* * * * *